US006494398B1

(12) United States Patent
De Matteis et al.

(10) Patent No.: US 6,494,398 B1
(45) Date of Patent: Dec. 17, 2002

(54) REWINDING METHOD AND MACHINE FOR MAKING LOGS OF PAPER AND THE LIKE

(75) Inventors: Alessandro De Matteis, Lucca; Sergio Landucci, Ponte a Moriano, both of (IT)

(73) Assignee: M T C Macchine Trasformazione Carta S.r.l.,, Porcari Lu (IT)

( * ) Notice: Subject to any disclaimer, the term of this patent is extended or adjusted under 35 U.S.C. 154(b) by 0 days.

(21) Appl. No.: 09/475,513

(22) Filed: Dec. 30, 1999

(30) Foreign Application Priority Data

Dec. 31, 1998 (EP) ..... 98830813

(51) Int. Cl.[7] ..... B65H 35/10
(52) U.S. Cl. ..... 242/521; 242/527
(58) Field of Search ..... 242/527, 521, 242/542, 542.1, 542.4

(56) References Cited

U.S. PATENT DOCUMENTS

| | | | | | |
|---|---|---|---|---|---|
| 1,719,830 | A | | 7/1929 | Cameron | |
| 3,869,095 | A | * | 3/1975 | Diltz | 242/542.4 |
| 4,327,877 | A | * | 5/1982 | Perini | 242/521 |
| 4,487,377 | A | * | 12/1984 | Perini | 242/542.4 |
| 4,687,153 | A | | 8/1987 | McNeil | |
| 4,909,452 | A | * | 3/1990 | Hertel et al. | 242/521 |
| 5,248,106 | A | * | 9/1993 | Biagiotti | 242/542 |
| 5,285,977 | A | * | 2/1994 | Biagiotti | 242/527 |
| 5,505,405 | A | * | 4/1996 | Vigneau | 242/542.1 |
| 5,542,622 | A | * | 8/1996 | Biagiotti | 242/521 |
| 5,690,296 | A | * | 11/1997 | Biagiotti | 242/521 |
| 5,979,818 | A | * | 11/1999 | Perini et al. | 242/521 |

FOREIGN PATENT DOCUMENTS

| | | | | |
|---|---|---|---|---|
| EP | 0454633 | B1 | 10/1991 | |
| EP | 0507749 | B1 | 10/1992 | |
| GB | 2188911 | A | 4/1987 | |
| GB | 2247670 | A | 7/1991 | |
| JP | 361119329 | * | 6/1986 | 242/527 |

* cited by examiner

*Primary Examiner*—Emmanuel M. Marcelo
(74) *Attorney, Agent, or Firm*—Simpson & Simpson, PLLC

(57) ABSTRACT

A method and a machine for rewinding a web (1) for making a log (2*a*), in particular for the production of rolls of toilet paper, rolls of all purpose wipers or household non woven fabric, industrial rolls and the like. The rewinding is carried out according to the steps of feeding a web (1) of paper into a winding cradle (4); arranging upstream of the cradle (4) a counter support roller (8) comprising at least a cutting slit (9) transversal to the web and a cutting roller (11) with a blade (10) so that it is possible the cut or tear the web (1) for contact of the blade (10) with the web (1); concluding the winding of the log (2*a*); winding the new log (2*b*) up to a predetermined length of the web (1); rotating with sliding the counter support roller (8) on the web (1) during the winding of the new log (2*b*) for causing the blade (10) to cut the web in a desired chosen location.

12 Claims, 6 Drawing Sheets

REWINDING METHOD AND MACHINE FOR MAKING LOGS OF PAPER AND THE LIKE

FIELD OF THE INVENTION

The present invention relates to a rewinding method for making logs starting from a web, for example used for the production of rolls of toilet paper, rolls of all purpose wipers, household non woven fabric, industrial rolls and the like.

Furthermore, the invention relates to a rewinding machine that carries out this method.

BACKGROUND OF THE INVENTION

Rewinding machines are known wherein a winding step is carried out on a log which is in contact surface with winding rollers. More precisely, the log is formed starting from a web of paper, continuous or with transversal perforations, which is carried by first dragging means, is wound partially on an upper winding roller, is in contact with a lower winding roller and is kept against the two upper and lower winding rollers by means of a pressure roller. The three rollers define a channel, or winding cradle, wherein the log is formed and the web of paper is supplied continuously and pulled by the surface frictional contact of the rollers on the log.

Normally, in the winding cradle the log is formed on a tubular core. Once the log has reached a predetermined diameter, normally calculated by checking the length of the developed paper, the web is cut or torn and the log is pushed away from the winding cradle at the side of the lower winding roller and, at the same time, a new core is supplied into the cradle by a pusher. It is possible, however, to wind the log without core as well.

Some types of rewinding machines, at the end of each roll winding step, provide a blade that cuts transversally the web by pressing against the upper winding roller. The upper winding roller has one or more cutting slits with which a retractable blade engages mounted on an adjacent cutting roller. This system has the drawback that it does not allow cuts having length not multiple of the circumference of the upper winding roller, or not multiple of the distance between two successive cutting slits when several cutting slits are provided for.

In the case, instead, of rewinding machines in which the web is torn, there is the drawback that the tearing step is subject to being carried out incorrectly. Actually, the web is stopped upstream of, or onto, the upper winding roller and the tearing is caused by the pulling action, on the web kept still, of the lower winding roller, on which the log is pushed by the pressure roller. Normally, it is sufficient to create a speed difference between said two rollers at the moment of the exchange in order to effect the tearing. However, the tearing sometimes cannot be made correctly, since it depends on the correct growth of the log being wound as well as on the presence and quality of the transversal perforation. Furthermore, with the tearing method rolls can be obtained whose development is multiple of the pitch between two transversal perforations only. Finally, in case of rolls without transversal perforations, for example industrial rolls, in order to effect the tearing it is necessary to make a special auxiliary perforation on the web at the end of the development of each roll.

SUMMARY OF THE INVENTION

It is an object of the present invention to provide a rewinding method of a web of paper for making logs, wherein the passage from a roll to the successive one is carried out by cutting the web and wherein the development of the web wound on the log after the cutting step has whichever desired length.

It is another object of the present invention to provide a rewinding machine of a web of paper for making logs that is capable of cutting the web upstream the winding zone in a desired location.

These and other objects are achieved by the web winding method for making a log whose characteristic is that it comprises the steps of:

- feeding a web of paper in a winding cradle;
- arranging upstream of the cradle a counter support roller that comprises at least a cutting slit transversal to the web;
- arranging a cutting roller that faces the counter support roller and comprises at least a blade transversal to the web, the web running between the counter support roller and the cutting roller;
- cutting or locally tearing the web for contact of the blade with the web in a predetermined moment at the slit of the counter support roller, the cut creating in the web a tail end and a front end;
- concluding the winding of the log that comprises the tail end and introducing the front end in the cradle for starting the winding of a new log;
- winding the new log up to a predetermined development of the web;
- decelerating or accelerating the counter support roller making it slide on the web while winding the new log so that the blade is ready to cut the web at a desired chosen location.

Preferably, the front end is pulled towards the winding cradle by a suction step carried out by the counter support roller.

Always preferably, the winding cradle comprises an upper winding roller, a lower winding roller and a pressure roller, the upper winding roller comprising suction means for capturing at least the front end of the web and starting the winding of the new log.

In a preferred embodiment, the upper winding roller has a plurality of radial holes, the front end of the web being captured by a predetermined sector of said holes belonging to an outer drum by means of an inner drum rotatable coaxially but in a way independent from the outer drum and suitable for selectively connecting the predetermined sector of the holes with a suction chamber.

The synchronization between the inner drum, the cutting roller and the counter support roller is obtained by a control step of driven axes operated by a computer, whereby, for every chosen web development between two successive cuts the computer arranges a reset phase of the counter support roller with respect to the blade and a relative rotation between the outer drum and the inner drum.

According to another aspect of the present invention, a rewinding apparatus of a web for making logs comprises:

- means for feeding and dragging a web of paper;
- a winding cradle wherein the winding of the log is carried out downstream the means for feeding;
- a counter support roller on which the web lays located in the space interval between the means for feeding and the cradle, the counter support roller having at least a cutting slit;
- a cutting roller suitable for bringing periodically a cutting blade against the counter support roller at its slit for cutting the web;

means for accelerating or decelerating the counter support roller and the cutting roller with respect to the web.

The cutting blade urges against the counter support roller for cutting the web creating a tail end of the previous log and a front end of a new log. Preferably, the counter support roller comprises suction means for dragging the front end towards the winding cradle.

Always preferably, the winding cradle comprises an upper winding roller, a lower winding roller and a pressure roller, the upper winding roller comprising means for capturing the front end of the web, said means for capturing may be suction means.

The upper winding roller comprises preferably an outer drum having a plurality of holes and an inner drum rotatable independently from the outer drum and suitable for connecting a predetermined sector of the holes with a suction chamber, whereby it is possible in turn to capture the front end by means of a predetermined sector of the outer drum.

In an advantageous embodiment of the invention the inner drum, the counter support roller and the cutting roller are brought into rotation by axes driven by at least a motor operated by a control unit that adjusts the cutting length of the web of said log, the motor decelerating or accelerating the rotation of said axes and causing said counter support roller to slide with respect to said web.

In order to make the sliding lighter the counter support roller has a surface with a plurality of small air blowing holes for reducing further the friction with respect to said web during the sliding step.

BRIEF DESCRIPTION OF THE DRAWINGS

Further characteristics and/or advantages of the rewinding method and of the rewinding apparatus according to the present invention will be made clearer with the following description of an embodiment thereof, exemplifying but not limitative, with reference to attached drawings wherein.

Figure 6:
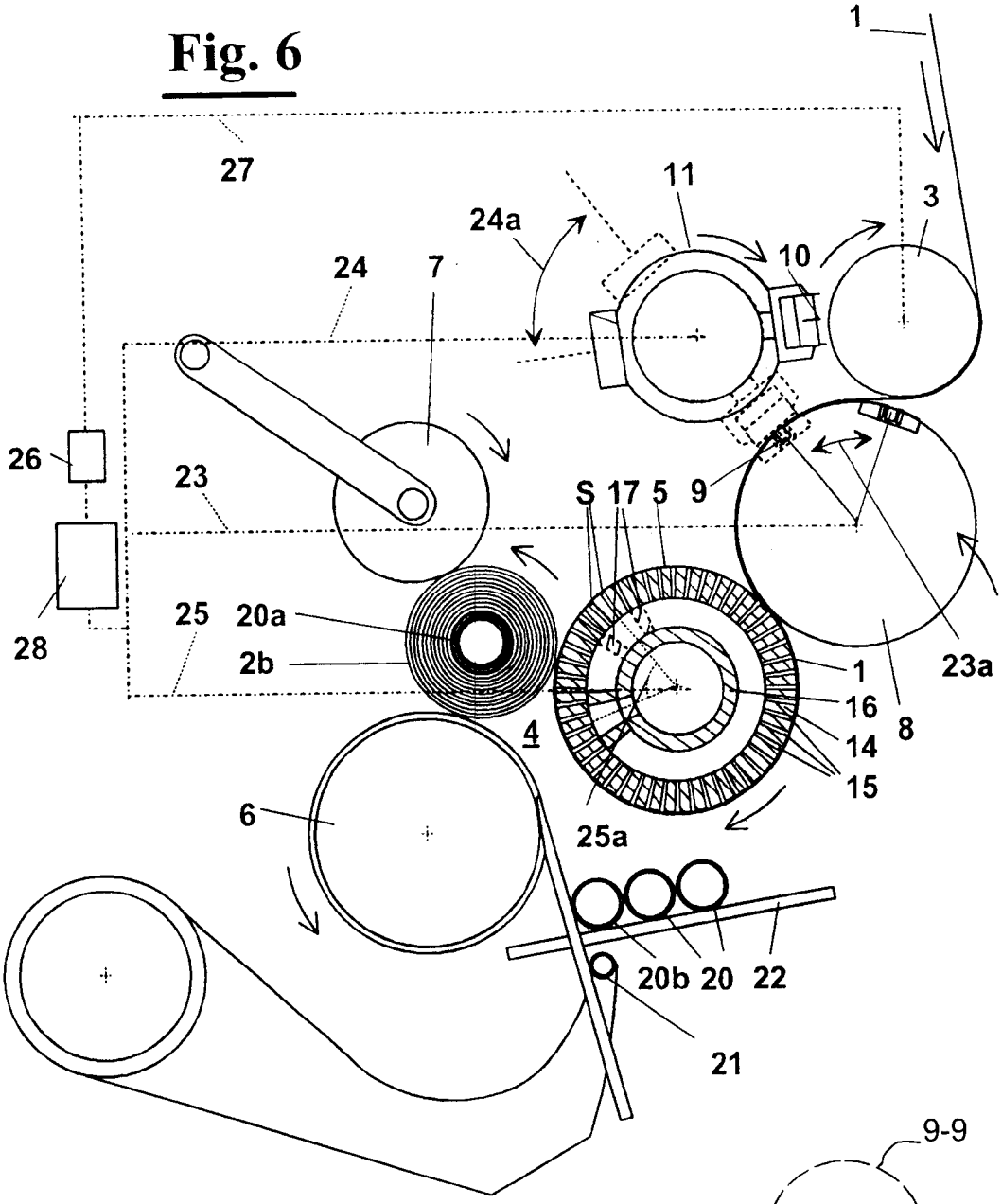

FIGS. from 2 to 5 show four different positions of the tail end of the web of the log being wound and of the front end of the web of the new log to be wound, as well as supplying steps of the core;

FIG. 6 shows the position of the rewinding machine of the previous figures ready for a cut at the conclusion of a log winding phase and a diagrammatical view of the means for adjusting the cutting length.

Figure 7:
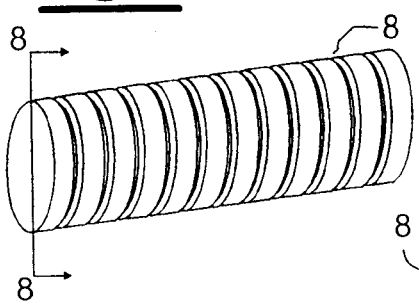
Figure 9:
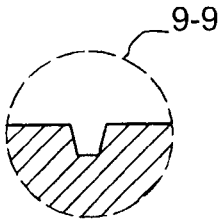
Figure 8:
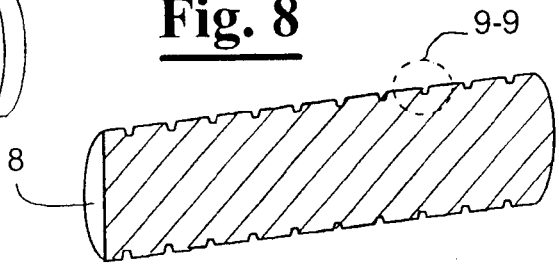

FIG. 7 is a perspective view of the counter support roller, illustrating the circumferential grooves of an embodiment of the present invention;

FIG. 8 is a longitudinal cross sectional view of the counter support roller with circumferential grooves;

FIG. 9 is a close up of a cross sectional view of a single circumferential groove in the counter support roller of an embodiment of the present invention.

DETAILED DESCRIPTION OF THE PREFERRED EMBODIMENT

Figure 1:
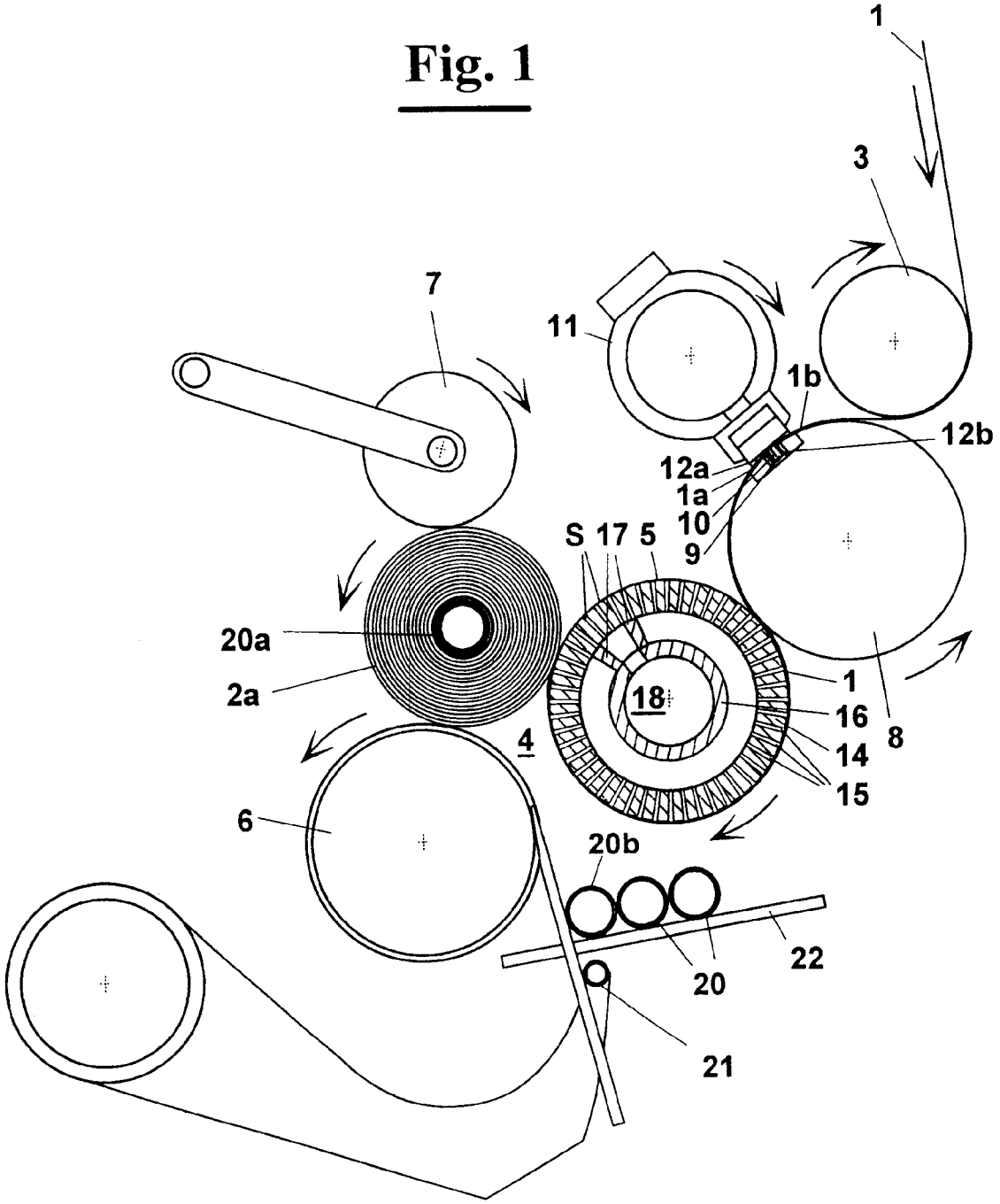
FIG. 1 shows a cross sectional view of a rewinding machine according to the present invention.

With reference to FIG. 1, a rewinding apparatus of a web 1 for making a log 2*a* comprises a feeding roller 3 of web 1 and, downstream of it, a winding cradle 4 wherein log 2*a* is wound.

Cradle 4, according to the prior art, comprises an upper winding roller 5, a lower winding roller 6 and a pressure roller 7. The latter follows the growth of log 2*a* with the tasks of assuring its continuous contact with winding rollers 5 and 6 and of controlling its diameter growth.

According to the invention, between feeding roller 3 and upper winding roller 5 a counter support roller 8 is provided on which web 1 rests. Counter support roller 8 is driven independently and has at least a cutting slit 9 in which a retractable blade 10 of a cutting roller 11 can engage. Cutting roller 11 brings periodically blade 10 against counter support roller 8 at the slit 9 for cutting web 1. When the cut has not to be carried out blade 11 retracts for not causing an undesired cut of the paper.

At the conclusion of each log, blade 10 urges against counter support roller 8 for cutting web 1 creating a tail end 1*a* of previous log 2*a* and a front end 1*b* of a new log.

Always according to the invention, counter support roller 8 has suction holes 12*a* and 12*b* along the edges of slit 9, suitable for capturing and dragging respectively tail end 1*a* and front end 1*b* of web 1. Also upper winding roller 5 comprises suction means comprising an outer drum 14 having a plurality of holes 15 and an inner drum 16 rotatable coaxially and independently from outer drum 14 and suitable for connecting, by means of radial walls 17, a chosen sector S of holes 15 with a suction chamber 18. This way it is possible in turn to capture front end 1*b* by means of a different chosen sector S of holes 15 of outer drum 14.

Log 2*a* already wound is dragged continuously rotating within cradle 4 by tangential friction against upper winding roller 5, lower winding roller 6 and pressure roller 7. The winding started about a core 20*a*, which had been supplied into cradle 4 by a loading unit 21 that draws cores 20 from a chute guide 22. In particular, a core 20*b* is ready for being wound around to form a log starting from front end 1*b* of web 1.

Counter support roller 8 has a smooth surface, continuous or discontinued by circumferential grooves, for providing a support to web 1, for allowing the cutting or tearing and for permitting, at predetermined moments, the sliding of the web thereon. In order to make easier the sliding for certain types of web having a greater friction factor its surface can also have a plurality of small air blowing holes.

The winding steps of web 1 for making a log 2*a* are the following.

The web of paper 1 is supplied into winding cradle 4 about core 20*a* up to a chosen length development predetermined upstream of feeding roller 3. Then, as shown in FIG. 1, after that a desired amount of web 1 has been developed upstream of cradle 4, counter support roller 8, at cutting slit 9, and transversal blade 10 of cutting roller 11 cut or tear web 1 separating tail end 1*a* from front end 1*b*. Cutting or tearing are equivalent at this stage since, with the presence of transversal perforations on the web, the action of the blade makes easier the tearing, whereas without perforation the blade carries out an actual cutting.

Figure 2:
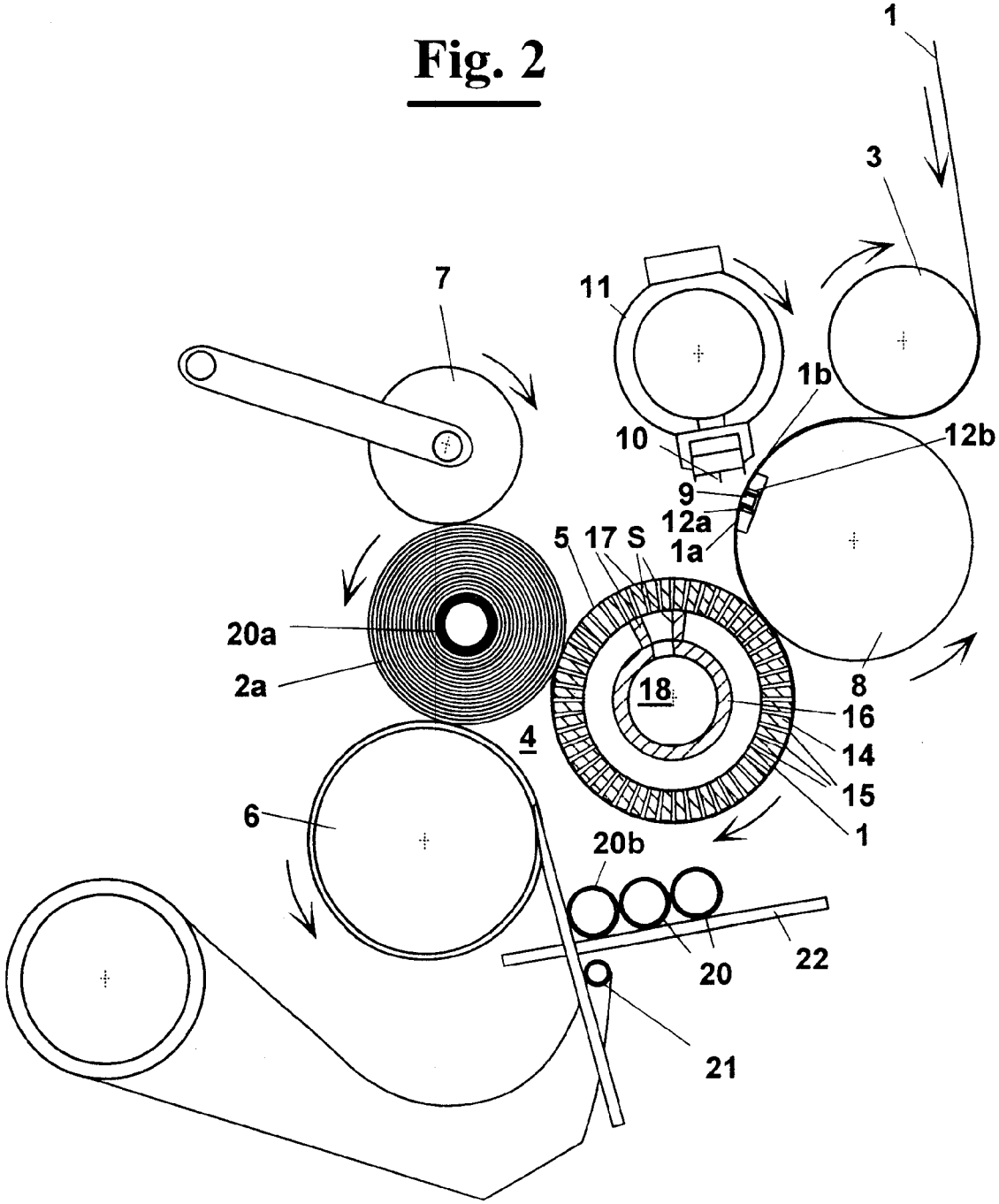
Figure 3:
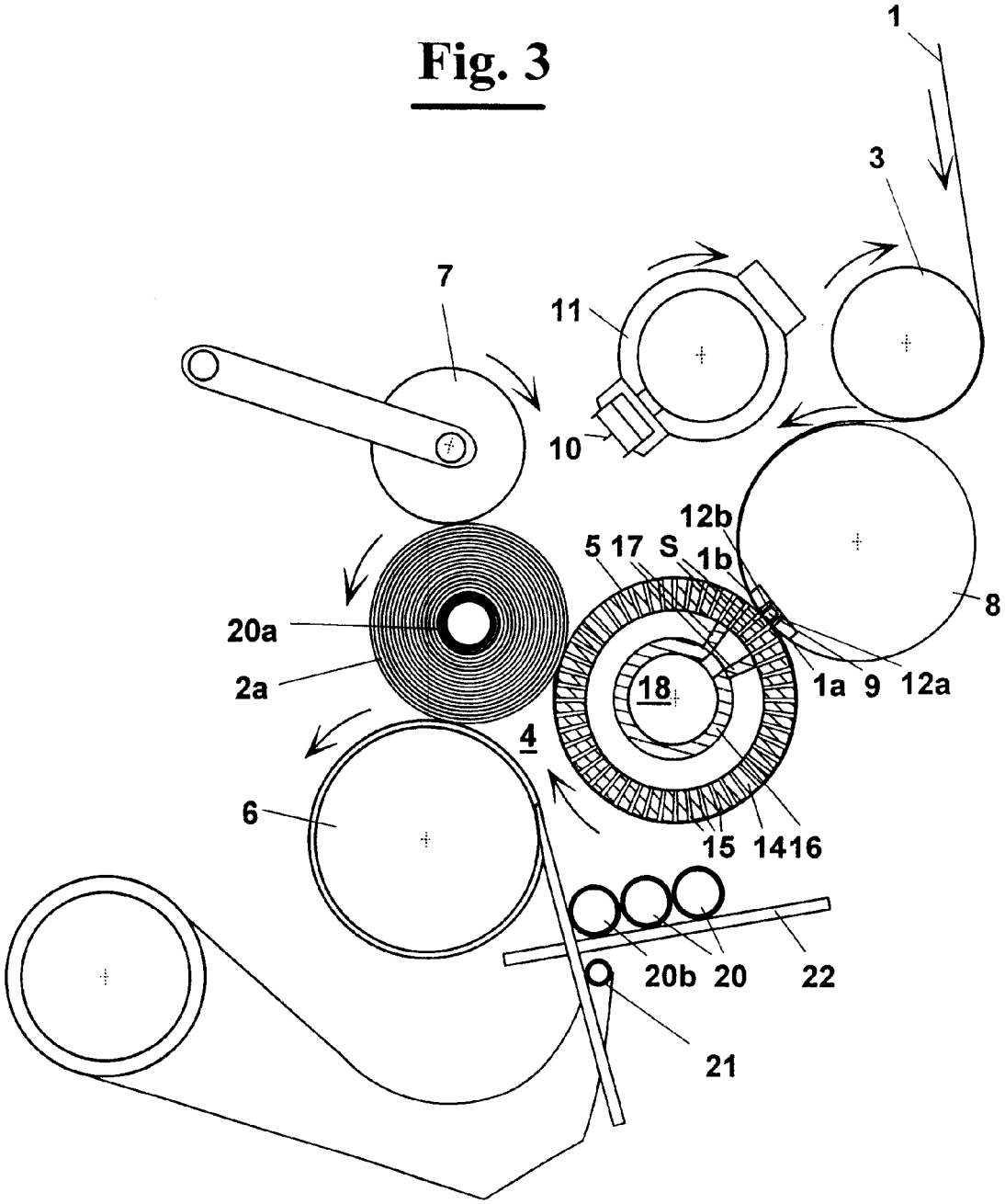
Figure 4:
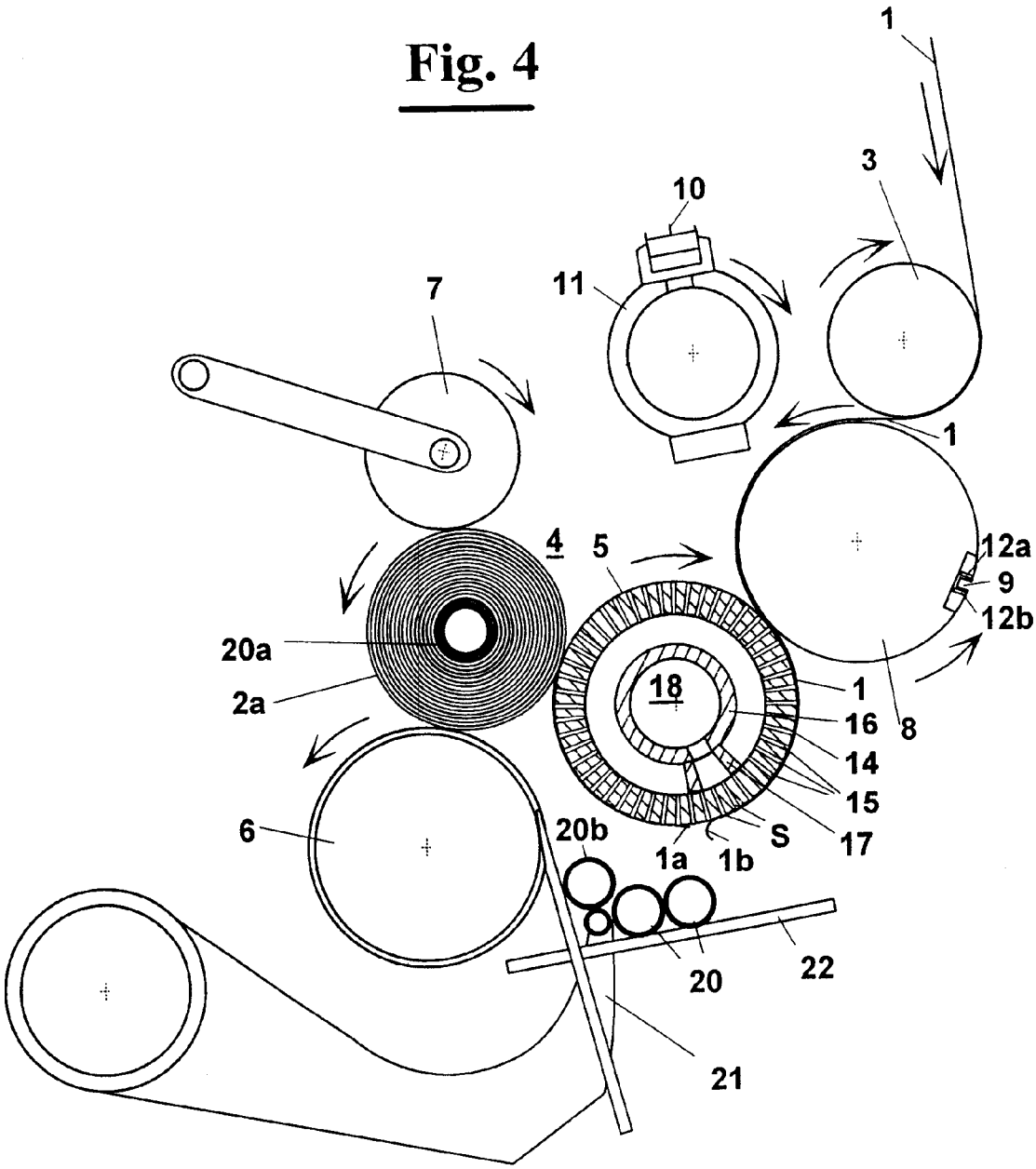
Figure 5:
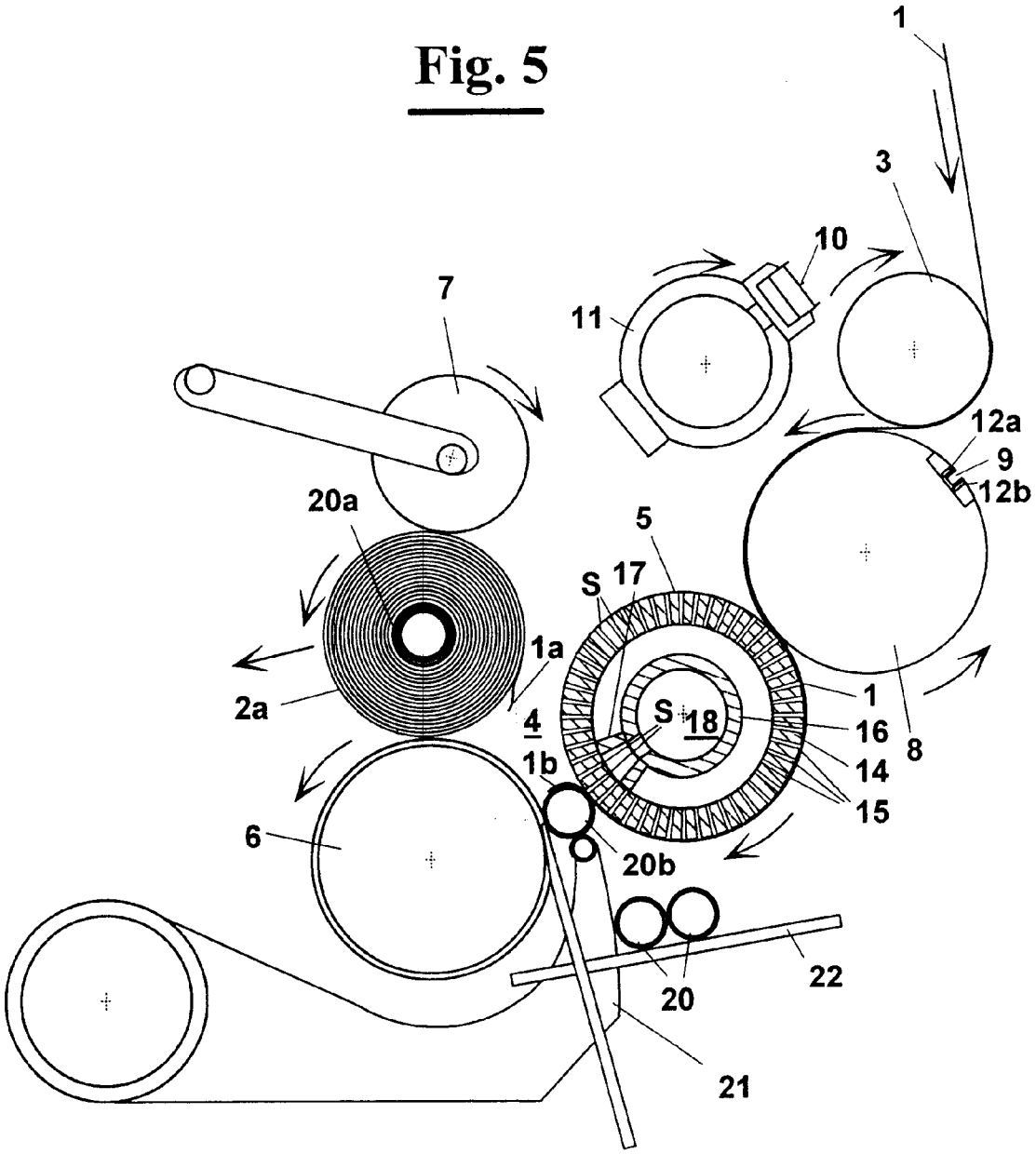

Then the various steps of bringing the front end towards the cradle are successively carried out, and precisely:

- suction holes 12*a* and 12*b* capture (FIG. 1) respectively tail end 1*a* and front end 1*b* allowing to counter support roller 8 to pull them (FIG. 2) up to bring them into contact with upper winding roller 5;
- then, holes 15 of outer drum 14 of upper winding roller 5, at the sector S for dragging front end 1*b*, become active owing to the position of walls 17 of the inner drum 16 (FIG. 3) and take tail end 1*a* and front end 1*b*; the latter is either folded, (like in FIG. 4) by means of suction by a portion of sector S at a certain distance from the transversal edge, or dragged just starting from the edge, according to how the outset of winding on core 20*b* is made;

the rotation between outer drum 14 and inner drum 16 is synchronous for bringing (FIG. 4) front end 1*b* towards cradle 4;

at the same time loading unit 21 pushes a core 20*b* of log 2*b* so that this encounters (FIG. 5) front end 1*b* at the entrance of cradle 4, which is at the same time freed from log 2*a* already wound.

Once started winding log 2*b* (FIG. 6), inner drum 16, counter support roller 8 and cutting roller 11, with blade 10 retracted (FIG. 5) continue to rotate, up to the conclusion of log 2*b* same.

Always as shown in FIG. 6, during the winding of log 2*b* inner drum 16, counter support roller 8 and cutting roller 11, for going back to the starting position of FIG. 1, by means of a check on the rotation of their axes 23, 24 and 25, in a predetermined step of the winding phase do not rotate any more in synchronizm with the speed of web 1, but do different rotations, variable in turn according to the position of the cut to make.

More precisely, counter support roller 8 slides relatively to web 1, rotating of a relative angle 23*a* without braking or accelerating the web, since there is only a slight friction between web 1 and roller 8 surface. Also cutting roller 11 and inner drum 16, in a way independent from outer drum 14, make a relative rotation 24*a* and 25*a* of equal linear development with respect to the movement of web 1.

The synchronization between inner drum 16, cutting roller 11 and counter support roller 8 is obtained by means of a control of the axes 23, 24 and 25 operated by the CPU 26, not shown in more detail since easily obtainable by a man of the art. Therefore, for every length of web chosen between two following cuts, CPU 26 arranges the phase reset of counter support roller 8 with respect to web 1, calculating the speed of the same for example starting from the speed of axis 27 of feeding roller 3 in synchronizm with a relative rotation of cutting roller 11 and of inner drum 16 with respect to outer drum 14.

It is possible, as shown diagrammatically in FIG. 6, that axes 23, 24 and 25 of counter support roller 8, of cutting roller 11 and of inner drum 16 are driven by a single motor 28 and connected by means of transmissions of suitable ratio, CPU 26 operating the rotation of the motor responsive to the speed of web 1.

Alternatively, the three axes are driven by distinct motors, for example DC motors, even of brushless type, and brought into rotation in synchronizm by CPU 26, which always operates their rotation responsive to the speed of web 1.

In both cases, the result is achieved that every log is wound with a web development having desired length. In fact, after rotation according to angles 23*a*, 24*a*, 25*a* at a speed, even slow, chosen by CPU 26, there is the possibility of cutting the web at a chosen location. All this is done independently from the circumference of roller 5 and without adversely affecting the winding phase of the log within cradle 4 by rollers 5, 6 and 7.

It is possible that counter support roller 8 has more than one cutting slit 9 for reducing further the time during which the web slides on roller 8

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What we claim is:

1. A method of making a log of web material, comprising the steps of:

feeding a web of material between a cutting roller and a counter support roller, said counter support roller comprising a slit to receive a cutter located within said cutting roller, wherein said counter support roller is operatively arranged to slidingly engage said web material to accommodate cutting at any desired location along said web;

feeding said web of material to a core positioned in a cradle located proximate said counter support roller, where said cradle comprises a lower winding roller, an upper winding roller, and a pressure roller, said upper winding roller operatively arranged to engage said web material by suction; and, cutting said web of material at a desired predetermined location with said cutter to create said log of web material, where said log comprises a predetermined length of said web material wound about said core.

2. The method of making a log of web material recited in claim 1 wherein said cutting of said web of material creates a length of material having a front end and a tail end, further comprising the step of dragging said front end toward said cradle by suction applied to said length of material proximate said front end, where said suction is applied by said counter support roller.

3. The method of making a log of web material recited in claim 2 wherein said upper winding roller includes a plurality of radial holes located on an outer drum of said upper winding roller, said front end of said length of material being captured by a chosen field of said plurality of holes by means of a co-axial inner drum of said upper winding roller, where said co-axial inner drum is rotatable independently from the outer drum and operatively arranged for selectively connecting said chosen field of said plurality of holes with a suction chamber present in said inner drum.

4. The method of making a log of web material recited in claim 3 further comprising the step of synchronizing said inner drum, said cutting roller and said counter support roller whereby, for every chosen web length between two successive cuts an acceleration or deceleration of said counter support roller, said cutting roller and said inner drum is made with respect to said web.

5. The method of making a log of web material recited in claim 4 wherein said step of synchronizing is accomplished by means of a control operated by a computer of the driven axes of rotation of said counter support roller, said cutting roller, and said inner drum, respectively.

6. An apparatus for making a log of web material, comprising:

a feeding roller;

a cutting roller;

a counter support roller operatively arranged to slidingly engage said web of material;

a winding cradle comprising a lower winding roller, an upper winding roller, and a pressure roller, wherein said feeding roller is operatively arranged to feed said web material between said cutting roller and said counter support roller to said log when said log is supported within said cradle, said cutting roller comprising a cutting blade operatively arranged to engage a slit within said counter support roller at a desired location to transversely cut said web material, wherein said upper winding roller comprises suction means for dragging a length of said web material towards said winding cradle; and, means for accelerating or decelerating said cutting roller and said counter support roller between cuts of said material to vary lengths of material cut.

7. The apparatus for making a log of web material recited in claim 6 wherein said suction means for dragging a length of said web material comprises suction holes in said upper winding roller.

8. The apparatus for making a log of web material recited in claim 7 wherein said upper winding roller comprises an outer drum having a plurality of holes and an inner co-axial rotatable independently from the outer drum and comprising means for connecting a predetermined section (S) of said holes with a suction chamber, said means for connecting said holes operatively arranged to capture at least some of said length of web material with some of said plurality of holes under suction.

9. The apparatus for making a log of web material recited in claim 8 wherein said inner drum, said counter support roller and said cutting roller are brought into rotation by driven axes operated by a motor operated by a control unit that adjusts cutting length of said web material of said log by decelerating or accelerating the rotation of said axes as necessary, causing said counter support roller to slidingly engage said web material.

10. The apparatus for making a log of web material recited in claim 8 wherein said counter support roller has a low friction continuous smooth surface.

11. The apparatus for making a log of web material recited in claim 10 wherein said counter support roller comprises a plurality of circumferential grooves.

12. The apparatus for making a log of web material recited in claim 10 wherein said low friction continuous smooth surface has a plurality of small air blowing holes.

* * * * *